US005687591A

United States Patent [19]

Siklosi et al.

[11] Patent Number: 5,687,591

[45] Date of Patent: Nov. 18, 1997

[54] SPHERICAL OR POLYHEDRAL DRY CLEANING ARTICLES

[75] Inventors: Michael Peter Siklosi; Thomas Allen DesMarais, both of Cincinnati, Ohio

[73] Assignee: The Procter & Gamble Company, Cincinnati, Ohio

[21] Appl. No.: 543,970

[22] Filed: Oct. 17, 1995

Related U.S. Application Data

[63] Continuation-in-part of Ser. No. 493,199, Jun. 20, 1995, abandoned.

[51] Int. Cl.[6] ..... D06F 39/02

[52] U.S. Cl. ..... 68/212; 34/330; 252/8.6

[58] Field of Search ..... 8/159; 68/242, 68/20, 212, 243; 239/34; 206/0.5; 252/8.6; 34/330, 331, 337

[56] References Cited

U.S. PATENT DOCUMENTS

| | | | |
|---|---|---|---|
| 1,747,324 | 2/1930 | Savitt . | |
| 2,679,482 | 5/1954 | Ross | 252/138 |
| 2,941,309 | 6/1960 | Cobb . | |
| 3,432,253 | 3/1969 | Dixon et al. | 8/142 |
| 3,591,510 | 7/1971 | Zenk | 252/137 |
| 3,593,544 | 7/1971 | Henderson | 68/12 |
| 3,633,538 | 1/1972 | Hoeflin | 68/20 |
| 3,647,354 | 3/1972 | Loeb | 8/158 |
| 3,676,199 | 7/1972 | Hewitt et al. | 17/109 |
| 3,705,113 | 12/1972 | Sharman | 252/555 |
| 3,737,387 | 6/1973 | Marple | 252/170 |
| 3,764,544 | 10/1973 | Haworth | 252/170 |
| 3,766,062 | 10/1973 | Wixon | 252/8.7 |
| 3,770,373 | 11/1973 | Schwartz | 8/142 |
| 3,882,038 | 5/1975 | Clayton et al. | 252/164 |
| 3,907,496 | 9/1975 | Néel et al. | 8/142 |
| 3,949,137 | 4/1976 | Akrongold | 428/311 |
| 3,956,198 | 5/1976 | BauerR | 252/542 |
| 3,956,556 | 5/1976 | McQueary | 428/131 |
| 4,007,300 | 2/1977 | McQueary | 427/242 |
| 4,063,961 | 12/1977 | Howard et al. | 134/4 |
| 4,097,397 | 6/1978 | Mizutani et al. | 252/153 |
| 4,102,824 | 7/1978 | Mizutani et al. | 252/545 |
| 4,115,061 | 9/1978 | Grünewälder | 8/137 |
| 4,126,563 | 11/1978 | Barker | 252/8.8 |
| 4,130,392 | 12/1978 | Diehl et al. | 8/101 |
| 4,139,475 | 2/1979 | Schwadtke et al. | 252/8.6 |
| 4,170,678 | 10/1979 | Urfer et al. | 428/124 |
| 4,188,447 | 2/1980 | Ehlenz | 428/310 |
| 4,219,333 | 8/1980 | Harris | 8/137 |
| 4,336,024 | 6/1982 | Denissenko et al. | 8/142 |
| 4,395,261 | 7/1983 | Lutz | 8/111 |
| 4,396,521 | 8/1983 | Borrello | 252/118 |
| 4,493,781 | 1/1985 | Chapman et al. | 252/88 |
| 4,563,187 | 1/1986 | Mesmer et al. | 8/137 |
| 4,594,362 | 6/1986 | Smith et al. | 521/52 |
| 4,606,842 | 8/1986 | Keyes et al. | 252/174.23 |

(List continued on next page.)

FOREIGN PATENT DOCUMENTS

| | | | |
|---|---|---|---|
| 1005204 | 2/1977 | Canada | 8/93.11 |
| 1295912 | 2/1992 | Canada | C11D 1/72 |

(List continued on next page.)

OTHER PUBLICATIONS

Trautwein, K., J. Nassal, Ch. Kopp & L. Karle, "The Disinfectant Action of Glycols on Tuberculosis Organisms and Their Practical Application", *Monatsh. Tierheilk*, vol. 7, Suppl. (1955) pp. 171–187. (Abstract only).

Ilg, H., & H. Fischer, "Synthesis and Application of Propoxylized Alcohols", *Text.–Prax.*, vol. 25, No. 8, (1970), pp. 484–487 (Abstract only).

(List continued on next page.)

*Primary Examiner*—Frankie L. Stinson

*Attorney, Agent, or Firm*—Jerry J. Yetter; Jacobus C. Rasser

[57] ABSTRACT

Articles especially adapted for in-home dry cleaning comprise a carrier in spherical or polyhedral form which is impregnated with a cleaning composition. Multiple articles are placed together with soiled garments in a sealed bag and tumbled, preferably in a hot air clothes dryer, to clean and refresh the garments.

7 Claims, 1 Drawing Sheet

U.S. PATENT DOCUMENTS

| | | | |
|---|---|---|---|
| 4,659,494 | 4/1987 | Soldanski et al. | 252/88 |
| 4,659,496 | 4/1987 | Klemm et al. | 252/90 |
| 4,666,621 | 5/1987 | Clark et al. | 252/91 |
| 4,692,277 | 9/1987 | Siklosi | 252/558 |
| 4,758,641 | 7/1988 | Hsu | 526/208 |
| 4,797,310 | 1/1989 | Barby et al. | 428/71 |
| 4,802,997 | 2/1989 | Fox et al. | 252/8.6 |
| 4,806,254 | 2/1989 | Church | 252/8.6 |
| 4,834,895 | 5/1989 | Cook et al. | 252/8.6 |
| 4,834,900 | 5/1989 | Soldanski et al. | 252/88 |
| 4,847,089 | 7/1989 | Kramer et al. | 424/405 |
| 4,849,257 | 7/1989 | Borcher et al. | 427/242 |
| 4,882,917 | 11/1989 | Mizusawa et al. | 68/17 A |
| 4,886,615 | 12/1989 | Dehan | 252/90 |
| 4,909,962 | 3/1990 | Clark | 252/547 |
| 4,938,879 | 7/1990 | Kellett | 252/8.75 |
| 4,943,392 | 7/1990 | Hastedt et al. | 252/539 |
| 4,966,724 | 10/1990 | Culshaw et al. | 252/158 |
| 4,983,317 | 1/1991 | Requejo et al. | 252/174.24 |
| 5,004,557 | 4/1991 | Nagarajan et al. | 252/174.24 |
| 5,035,826 | 7/1991 | Durbut et al. | 252/121 |
| 5,040,311 | 8/1991 | Roy | 34/60 |
| 5,041,230 | 8/1991 | Borcher et al. | 252/8.9 |
| 5,051,212 | 9/1991 | Culshaw et al. | 252/546 |
| 5,061,393 | 10/1991 | Linares et al. . | |
| 5,062,973 | 11/1991 | Kellett | 252/8.75 |
| 5,066,413 | 11/1991 | Kellett | 252/8.75 |
| 5,080,822 | 1/1992 | Van Eenam | 252/170 |
| 5,102,573 | 4/1992 | Han et al. | 252/153 |
| 5,108,643 | 4/1992 | Loth et al. | 252/174.11 |
| 5,108,660 | 4/1992 | Michael | 252/545 |
| 5,112,358 | 5/1992 | Deal | 8/137 |
| 5,133,967 | 7/1992 | Smith | 424/401 |
| 5,145,523 | 9/1992 | Halpin | 106/287.24 |
| 5,173,200 | 12/1992 | Kellett | 252/8.8 |
| 5,202,045 | 4/1993 | Karpusiewicz et al. | 252/90 |
| 5,213,624 | 5/1993 | Williams | 134/40 |
| 5,232,632 | 8/1993 | Woo et al. | 252/546 |
| 5,236,710 | 8/1993 | Guerrero et al. | 424/401 |
| 5,238,587 | 8/1993 | Smith et al. | 252/8.6 |
| 5,286,400 | 2/1994 | Paszek et al. | 252/88 |
| 5,304,334 | 4/1994 | Lahanas et al. | 252/314 |
| 5,322,689 | 6/1994 | Hughes et al. | 424/401 |
| 5,336,445 | 8/1994 | Michael et al. | 252/548 |
| 5,336,497 | 8/1994 | Guerrero et al. | 424/401 |
| 5,342,549 | 8/1994 | Michael | 252/546 |
| 5,344,643 | 9/1994 | Thiel et al. | 424/70 |
| 5,350,541 | 9/1994 | Michael et al. | 252/548 |
| 5,362,422 | 11/1994 | Masters | 252/544 |
| 5,380,528 | 1/1995 | Alban et al. | 424/401 |
| 5,415,812 | 5/1995 | Durbut et al. | 252/547 |

FOREIGN PATENT DOCUMENTS

| | | | |
|---|---|---|---|
| 0 208 989 | 1/1987 | European Pat. Off. | D06L 1/00 |
| 0 213 500 | 3/1987 | European Pat. Off. | C11D 17/00 |
| 0 232 530 | 8/1987 | European Pat. Off. | C11D 3/43 |
| 0 261 718 | 3/1988 | European Pat. Off. | C11D 17/00 |
| 261 874 | 3/1988 | European Pat. Off. | C11D 3/43 |
| 286167 | 10/1988 | European Pat. Off. | C11D 3/20 |
| 0329209 | 8/1989 | European Pat. Off. | C11D 3/43 |
| 0 334 463 | 9/1989 | European Pat. Off. | C11D 3/44 |
| 0 347 110 | 12/1989 | European Pat. Off. | C11D 1/83 |
| 0 429 172 A1 | 5/1991 | European Pat. Off. | D06F 43/00 |
| 0 491 531 | 6/1992 | European Pat. Off. | C11D 1/68 |
| 503 219 | 9/1992 | European Pat. Off. | C11D 3/30 |
| 0513948 | 11/1992 | European Pat. Off. | C11D 7/32 |
| 595383 | 5/1994 | European Pat. Off. | C11D 1/92 |
| 2240287 | 7/1975 | France | C11D 17/06 |
| 2021561 | 11/1970 | Germany . | |
| 2460239 | 7/1975 | Germany | C11D 17/04 |
| 3904610 | 8/1990 | Germany . | |
| 4007362 | 9/1991 | Germany | D06F 58/00 |
| 4129986 | 11/1993 | Germany | A61K 7/48 |
| 53-058095 | 5/1978 | Japan . | |
| 61/014298 | 1/1986 | Japan . | |
| 61-085498 | 5/1986 | Japan | C11D 10/02 |
| 62-252499 | 11/1987 | Japan | C11D 3/60 |
| 63-051500 | 3/1988 | Japan | C11D 3/60 |
| 2-206695 | 8/1990 | Japan | C11D 1/68 |
| 5-171566 | 7/1993 | Japan | D06L 1/04 |
| 5-280889 | 10/1993 | Japan | 62/303 |
| 6-049497 | 2/1994 | Japan | C11D 7/60 |
| 6-049498 | 2/1994 | Japan | C11D 7/60 |
| 6-146041 | 5/1994 | Japan | C23G 5/032 |
| 1397475 | 6/1975 | United Kingdom | C11D 10/02 |
| 1598911 | 9/1981 | United Kingdom | D06F 43/00 |
| WO 91/09104 | 6/1991 | WIPO | C11D 7/32 |
| WO 91/11505 | 8/1991 | WIPO | C11D 1/90 |
| WO 91/13145 | 9/1991 | WIPO | C11D 7/50 |
| WO 91/19713 | 11/1992 | WIPO | C11D 17/00 |
| WO 93/04151 | 3/1993 | WIPO | C11D 1/83 |
| WO 93/06204 | 4/1993 | WIPO | C11D 7/50 |
| WO 93/25654 | 12/1993 | WIPO | C11D 7/50 |
| WO 94/05766 | 3/1994 | WIPO | C11D 7/50 |
| WO 94/09108 | 4/1994 | WIPO | C11D 10/04 |

OTHER PUBLICATIONS

Komarova, L.F., U. N. Garber & L. G. Chub, "Physical Properties of Monoethers of Mono–and Diglycols", *Zh. Obshch. Khim.*, vol. 40, No. 11 (1970), p. 2534, Russian (Abstract only).

Sokolowski, A. & J. Chlebicki, "The Effect of Polyoxypropylene Chain Length in Nonionic Surfactants on Their Adsorption at the Aqueous Solution–Air Interface", *Tenside Deterg.*, vol. 19, No. 5 (1982), pp. 282–286 (Abstract only).

Hamlin, J. E., "Propylene Glycol Ethers and Esters in Solvent–Based Paint Systems", *Congr. FATIPEC*, 17th (4), (1984), pp. 107–122 (Abstract only).

DeFusco, A.J., "Coalescing Solvents for Architectural and Industrial Waterborne Coatings", *Proc. Water–Borne Higher–Solids Coat. Symp.*, 15th, (1988), pp. 297–330 (Abstract only).

Vance, R.G., N.H. Morris & C. M. Olson, "Coupling Solvent Effects on Water–Reducible Alkyd Resins", *Proc. Water–Born Higher–Solids Coat. Symp.*, 16th (1989), pp. 269–282 (Abstract only).

Szymanowski, J., "The Estimation of Some Properties of Surface Active Agents", *Tenside, Surfactants, Deterg.*, vol. 27, No. 6 (1990), pp. 386–392 (Abstract only).

Spauwen, J., R. Ziegler & J. Zwinselman, "New Polypropylene Glycol–based Solvents for Aqueous Coating Systems", *Spec. Publ.—R. Soc. Chem.* 76 (Addit. Water–Based Coat.), (1990) (Abtract only).

Sokolowski, A., "Chemical Structure and Thermodynamics of Amphiphile Solutions. 2. Effective Length of Alkyl Chain in Oligooxyalkylenated Alcohols", *Colloids Surf.*, vol. 56 (1991), pp. 239–249 (Abstract only).

Asgharian, N., P. Otken, C. Sunwoo & W. H. Wade, "Synthesis and Peformance of High–Efficiency Cosurfactants. 1. Model Systems", *Langmuir*, vol. 7, No. 12 (1991), pp. 2904–2910. (Abstract only).

U.S. application No. 08/545,441, Davis, filed Oct. 17, 1995.

U.S. application No. 08/544,228, Siklosi, filed Oct. 17, 1995.

U.S. application No. 08/544,234, Siklosi et al., filed Oct. 17, 1995.

U.S. application No. 08/544,235, Roetker, filed Oct. 17, 1995.
U.S. application No. 08/544,373, Roetker, filed Oct. 17, 1995.
U.S. application No. 08/544,360, Siklosi et al., filed Oct. 17, 1995.
U.S. application No. 08/544,354, Young et al., filed Oct. 17, 1995.
U.S. application No. 08/544229, Trinh et al., filed Oct. 17, 1995.
U.S. application No. 08/545,442, Roetker et al., filed Oct. 17, 1995.
U.S. application No. 08/544,239, Hortel, filed Oct. 17, 1995.
U.S. application No. 60/005,684, Davis et al., filed Oct. 17, 1995.

SPHERICAL OR POLYHEDRAL DRY CLEANING ARTICLES

CROSS REFERENCE TO RELATED APPLICATION

This is a continuation-in-part of application Ser. No. 08/493,199, filed Jun. 20, 1995 now abandoned.

FIELD OF THE INVENTION

The present invention relates to freely moving, compressible spheres or polyhedra which carry a composition to clean garments in a dry cleaning process. The spheres are especially useful for in-home dry cleaning.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

While solvent-based dry cleaning processes are quite effective for removing oily soils and stains, they are not optimal for removing particulates such as clay soils, and may require special treatment conditions to remove proteinaceous stains. Ideally, particulates and proteinaceous stains are removed from fabrics using detersive ingredients and operating conditions which are more akin to aqueous laundering processes than to conventional dry cleaning.

In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

As can be seen from the foregoing, and aside from the effects on certain fabrics such as woolens, there are no special, inherent advantages for solvent-based immersion dry cleaning over aqueous cleaning processes with respect to fabric cleaning or refreshment. Moreover, on a per-garment basis, commercial dry cleaning is much more expensive than aqueous cleaning processes. Accordingly, it would be of considerable benefit to consumers to provide non-immersion dry cleaning processes which can be used in the home.

One type of home dry cleaning system comprises a carrier sheet containing various cleaning agents, and a plastic bag. The garments to be cleaned are placed in the bag together with the sheet, and then tumbled in a conventional clothes dryer. In a commercial embodiment, multiple single-use flat sheets and a single multi-use plastic bag are provided in a package. Unfortunately, such sheets can become entrapped in the garments during the tumbling operation, whereupon they no longer function properly.

By the present invention, it has been discovered that the above-described flat sheets can be replaced by a multiplicity (typically two to about 100) of 3-dimensional articles releasably containing the dry cleaning composition. In the event that some of the articles become entrapped in the garments, the remaining articles are free to complete the cleaning process. This results in improved cleaning performance.

Accordingly, it is an object of the present invention to provide improved articles for use in a dry cleaning operation. Another object is to provide improved cleaning performance in a home dry cleaning process. These and other objects are secured herein, as will be seen from the following disclosure.

BACKGROUND ART

Dry cleaning processes are disclosed in: EP 429,172A1, published May 29, 1991, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. No. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EP0 261 718; G.B. 1,397,475; WO 91/09104; WO 91/13145; WO 93/25654 and Hunt, D. G. and N. H. Morris, "PnB and DPnB Glycol Ethers", *HAPPI*, April 1989, pp. 78–82.

SUMMARY OF THE INVENTION

The present invention encompasses a preferred fabric cleaning article comprising a compressible, substantially spherical, absorbent substrate carrying a cleaning composition removable to fabrics by contact therewith. In a typical mode, the spheres have a diameter of from about 1 cm to about 5 cm. Polyhedral structures which approximate spheres, e.g., "geodesic" structures formed by combining two eicosahedral structures, are equivalent to the spheres for the purposes of this invention. Other polyhedral structures are also useful herein, as will be seen hereinafter.

Preferred cleaning compositions used in the present articles comprise an organic solvent, a polyacrylate emulsifier, water, optional 1,2-octanediol and optional surfactants. Most preferably, the organic solvent is a member selected from the group consisting of methoxy-, ethoxy-, propoxy-, and butoxy- propoxypropanol, and mixtures thereof.

The invention also encompasses a method for cleaning fabrics in a tumbling apparatus, comprising placing said fabrics in a container together with one or more, preferably at least about 3, typically from about 3 to about 6, articles as described above, closing said container, and tumbling said fabrics together with said article. The method is conveniently conducted in a hot air clothes dryer.

The invention also encompasses a dry cleaning composition in kit form, comprising the following components:

(a) multiple, spherical or polyhedral articles, as disclosed herein which, typically, are intended for a single usage;

(b) a reusable container, especially a plastic bag, for use in a hot air clothes dryer or other, equivalent, tumbling apparatus; and (c) an outer package containing said components (a) and (b).

One advantage of the present process is that the formulator can employ different, and even otherwise incompatible, cleaning and fabric care ingredients on separate articles. In-use, several articles, each containing different ingredients, can be used, thereby providing multiple cleaning and fabric care benefits.

All percentages, ratios and proportions herein are by weight, unless otherwise specified. All documents cited are, in relevant part, incorporated herein by reference.

DETAILED DESCRIPTION OF THE INVENTION

Figure 1:
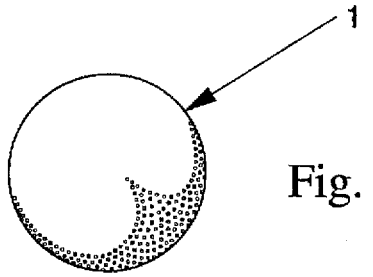
FIG. 1 is a perspective of a cleaning sphere of the present invention.

The carrier spheres and polyhedra for the cleaning compositions herein and their use in the dry cleaning process of the present invention are described hereinafter.

Substrate—The carrier herein is in the form of a soft, compressible spherical (or polyhedral) body which substantially maintains its structural integrity throughout the cleaning process. Such spheres (or polyhedra) can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth may also be used, but is not preferred over non-wovens due to cost considerations. The hydroentangled absorbent material available from Dexter, Non-Wovens Division, The Dexter Corporation as HYDRASPUN®, especially Grade 10244, is preferred herein. Most preferably, the compressible carrier is prepared from absorbent natural or synthetic sponges, absorbent open-cell foams such as polyurethane, and the like.

The carrier is designed to be safe and effective under the intended operating conditions of the present process. The carrier must not be flammable during the process, nor should it deleteriously interact with the cleaning composition or with the fabrics being cleaned. The carrier used herein is most preferably non-linting. By "non-linting" herein is meant that the carrier resists the shedding of visible fibers or other residue onto the fabrics being cleaned, i.e., the deposition of what is known in common parlance as "lint". A carrier can easily and adequately be judged for its acceptability with respect to tinting by rubbing it on a piece of dark blue woolen cloth and visually inspecting the cloth for lint residues.

Non-linting carriers used herein can be prepared by several means, including but not limited to: preparing the carrier in the form of spheres or polyhedra from a single strand of fiber; or employing known bonding techniques commonly with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, may shed lint. The core is then enveloped within a sheet of porous, non-linting material having a pore size which allows passage of the cleaning compositions herein but through which lint from the core cannot pass. An example of such a carrier comprises a cellulose fiber core enveloped in a non-woven polyester scrim. Lint resistance is of little concern when the preferred open-celled foams or sponges are used.

The preferred carrier spheres (or other polyhedra) should be of a size which provides sufficient surface area that effective contact between the surface of the carrier and the surface of the fabrics being cleaned is achieved. Of course, the size should not be so large as to be unhandy for the user. Typically, the dimensions of a sphere will be sufficient to provide a macroscopic total surface area of at least about 12 $cm^2$, preferably in the range from about 12 $cm^2$ to about 315 $cm^2$.

The most preferred compressible spherical carrier herein is prepared from compressible foams. In addition to spheres and related polyhedra, more simple geometric figures are also possible while retaining all of the advantages of spheres. For example, nested patterns that can be cut from a slab of foam from about 2 cm to 10 cm thick such as squares, rectangles, hexagons, bow ties, dogbones, and similar repeating geometries would avoid cutting waste. Other semi-nesting figures, e.g., octagons, decagons, stars, half-moons, and the like, are useful but will make foam scrap. Non-nesting figures such as cylinders can also function, but are even higher cost due to scrap. Mixtures of these figures and thicknesses are also possible. Compression cutting techniques, as are known in the art for preparing "egg crate", combined with the nested and other figures, would result in such mixtures directly. One yardstick for the utility of these non-spherical entities is the aspect ratio, which is the ratio of the longest cross-sectional dimension to the shortest cross-sectional dimension. The polyhedral carriers herein should have an aspect ratio of less than 20:1, preferably less than 10:1, most preferably less than 5:1.

The carrier is intended to contain a sufficient amount of the cleaning composition to be effective for its intended purpose. The capacity of the carrier for the cleaning composition will vary according to the intended usage. For example, carrier/cleaning composition articles which are intended for a single use will require less capacity than such articles which are intended for multiple uses.

Cleaning Compositions—The chemical compositions which are used to provide the cleaning function in the present dry cleaning process comprise ingredients which are safe and effective for their intended use. Since the process herein does not involve an aqueous rinse step, the cleaning compositions employ ingredients which do not leave undesirable residues on fabrics when employed in the manner disclosed herein. Moreover, since the process may be carried out in a hot air clothes dryer, the compositions contain only ingredients whose flash points render them safe for such use. The cleaning compositions contain water, since water not only aids in the cleaning function, but also can help remove wrinkles and restore fabric drape and appearance, especially in hot air dryers. While conventional laundry detergents are typically formulated to provide good cleaning on cotton and cotton/polyester blend fabrics, the cleaning compositions herein must be formulated to also safely and effectively clean and refresh fabrics such as wool, silk, rayon, rayon acetate, and the like.

In addition, the cleaning compositions herein comprise ingredients which are specially selected and formulated to minimize dye removal from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred cleaning compositions herein are formulated to minimize or avoid this problem.

The dye removal attributes of the present cleaning compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) "I see a lot of dye on the towel"; through (4) "I know I see quite a lot of dye on the towel" are assigned by panelists.

In addition to the foregoing considerations, the cleaning composition herein is preferably formulated such that it is not so adhesive in nature that it renders the carriers unhandy or difficult to remove from their package. Moreover, while it is acceptable that the carriers herein be moist to the touch, they preferably do not have a slimy or adhesive feel. The acceptability of the carriers which contain the cleaning composition in regard to such matters can be judged without undue experimentation. However, and while not intending to be limiting of the present invention, the following cleaning compositions afford dry cleaning articles of the present type which are both effective for their intended cleaning and fabric refreshment purposes and aesthetically pleasing.

Having due regard to the foregoing considerations, the following illustrates the ingredients used in the cleaning compositions herein, but is not intended to be limiting thereof.

(a) Solvent—The compositions will preferably comprise at least about 4%, typically from about 5% to about 25%, by weight, of solvent. The objective is to provide at least about 0.4 g, preferably from about 0.5 g to about 2.5 g, of solvent per kg of fabrics being cleaned.

(b) Emulsifier—The compositions will comprise sufficient emulsifier to provide a stable, homogeneous composition comprising components (a), (b) and (d). For the preferred emulsifiers disclosed hereinafter, levels as low as 0.05%, preferably 0.07% to about 0.20%, by weight, are quite satisfactory. If less efficient emulsifiers are used, levels up to about 2%, by weight, can be used, but may leave some noticeable residues on the fabrics.

(c) Water—The compositions will comprise at least about 60%, typically from about 80% to about 95%, by weight, of water. Stated otherwise, the objective is to provide at least about 6 g of water per kg of fabrics being cleaned.

(d) Optionals—The compositions herein may comprise various optional ingredients, including perfumes, conventional surfactants, and the like. If used, such optional ingredients will typically comprise from about 0.1% to about 10%, by weight, of the compositions, having due regard for residues on the cleaned fabrics.

It has now been determined that 1,2-octanediol ("OD") affords special advantages in the formulation of the cleaning compositions herein. From the standpoint of aesthetics, OD is a relatively innocuous and low odor material. Moreover, OD appears to volatilize from fabric surfaces without leaving visible residues. This is especially important in a dry cleaning process of the present type which is conducted without a rinse step. From the performance standpoint, OD appears to function both as a solvent for greasy/oily stains and as what might be termed a "pseudo-surfactant" for particulate soils and water-soluble stains. Whatever the physical-chemical reason, OD has now been found to be a superior wetting agent with respect to both cleaning and ease-of-use in the present context of home-use cleaning compositions and processes. If used, OD will comprise at least about 0.05%, typically from about 0.1% to about 1.5%, by weight of the cleaning compositions herein.

A preferred solvent herein is butoxy propoxy propanol (BPP) which is available in commercial quantities as a mixture of isomers in about equal amounts. The isomers, and mixtures thereof, are useful herein. The isomer structures are as follows:

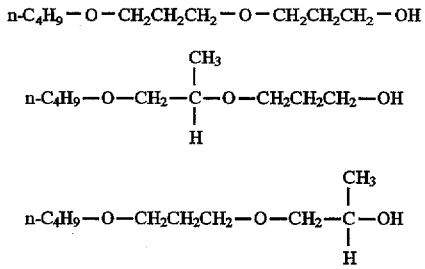

BPP is outstanding for cleaning, and is so effective that it allows the amount of the relatively expensive 1,2-octanediol to be minimized. Moreover, it allows for the formulation of effective cleaning compositions herein without the use of conventional surfactants. Importantly, the odor of BPP is of a degree and character that it can be relatively easily masked by conventional perfume ingredients. While BPP is not completely miscible with water and, hence, could negatively impact processing of the cleaning compositions herein, that potential problem has been successfully overcome by means of the PEMULEN-type polyacrylate emulsifiers, as disclosed hereinafter.

The BPP solvent used herein is preferably a mixture of the aforesaid isomers. In a preferred mode, the cleaning compositions comprise a mixture of the 1,2-octanediol and BPP, at a weight ratio of OD:BPP in the range of from about 1:250 to about 2:1, preferably from about 1:200 to about 1:5.

A highly preferred emulsifier herein is commercially available under the trademark PEMULEN, The B. F. Goodrich Company, and is described in U.S. Pat. Nos. 4,758,641 and 5,004,557, incorporated herein by reference. PEMULEN polymeric emulsifiers are high molecular weight polyacrylic acid polymers. The structure of PEMULEN includes a small portion that is oil-loving (lipophilic) and a large water-loving (hydrophilic) portion. The structure allows PEMULEN to function as a primary oil-in-water emulsifier. The lipophilic portion adsorbs at the oil-water interface, and the hydrophilic portion swells in the water forming a network around the oil droplets to provide emulsion stability. An important advantage for the use of such polyacrylate emulsifiers herein is that cleaning compositions can be prepared which contain solvents or levels of solvents that are otherwise not soluble or readily miscible with water. A further advantage is that effective emulsification can be accomplished using PEMULEN-type emulsifier at extremely low usage levels (0.05–0.2%), thereby minimizing the level of any residue left on fabrics following product usage. For comparison, typically about 3–7% of conventional anionic or nonionic surfactants are required to stabilize oil-in-water emulsions, which increases the likelihood that a residue will be left on the fabrics. Another advantage is that emulsification (processing) can be accomplished effectively at room temperature.

While the cleaning compositions herein function quite well with only the 1,2-octanediol, BPP, PEMULEN and water, they may also optionally contain detersive surfactants to further enhance their cleaning performance. While a wide variety of detersive surfactants such as the $C_{12}$–$C_{16}$ alkyl sulfates and alkylbenzene sulfonates, the $C_{12}$–$C_{16}$ ethoxylated (EO 0.5–10 avg.) alcohols, the $C_{12}$–$C_{14}$ N-methyl glucamides, and the like can be used herein, it is highly preferred to use surfactants which provide high grease/oil removal. Included among such preferred surfactants are the $C_{12}$–$C_{16}$ alkyl ethoxy sulfates (AES), especially in their magnesium salt form, and the $C_{12}$–$C_{16}$ dimethyl amine oxides. Especially preferred mixtures comprise $MgAE_1S$/$MgAE_{6.5}S$/$C_{12}$ dimethyl amine oxide, at a weight ratio of about 1:1:1, and $MgAE_1S$/$C_{12}$ dimethyl amine oxide at a 2:1 weight ratio. If used, such surfactants will typically comprise from about 0.05% to about 2.5%, by weight, of the cleaning compositions herein.

In addition to the preferred solvents and emulsifiers disclosed above, the cleaning compositions herein may comprise various optional ingredients, such as perfumes, preservatives, co-solvents, brighteners, salts for viscosity control, pH adjusters or buffers, anti-static agents, softeners, colorants, mothproofing agents, insect repellents, and the like.

Container—The present cleaning process is conducted using a flexible container. As noted, the fabrics to be cleaned are placed within the container with several of the sphere or polyhedral/cleaning composition articles, and the container is agitated, thereby providing contact between the cleaning articles and the surfaces of the fabrics.

The flexible container used herein can be provided in any number of configurations, and is conveniently in the form of a flexible pouch, or "bag", which has sufficient volume to contain the fabrics being cleaned. The container can be of any convenient size, and should be sufficiently large to allow tumbling of the container and fabrics therein, but should not be so large as to interfere with the operation of the tumbling apparatus. With special regard to containers intended for use in hot air clothes dryers, the container must not be so large as to block the air vents. If desired, the container may be small enough to handle only a single shirt, blouse or sweater, or be sufficiently large to handle a man's suit. Suitable containers can be manufactured from any economical material, such as polyester, polypropylene, and the like, with the proviso that it must not melt if used in contact with hot dryer air. It is preferred that the walls of the container be substantially impermeable to water vapor and solvent vapor under the intended usage conditions. It is also preferred that such containers be provided with a sealing means which is sufficiently stable to remain closed during the cleaning process. Simple tie strings or wires, various snap closures such as ZIP LOK® closures, and VELCRO®-type closures, contact adhesives, adhesive tape, zipper-type closures, and the like, suffice.

Process—The present cleaning process can be conducted in any manner which provides mechanical agitation, such as a tumbling action, to the container with the fabrics being cleaned. If desired, the agitation may be provided manually. However, in a convenient mode a container with several of the cleaning articles and enveloping the soiled fabric is sealed and placed in the drum of an automatic clothes dryer. The drum is allowed to revolve, which imparts a tumbling action to the container and agitation of its contents concurrently with the tumbling. By virtue of this agitation, the fabrics come in contact with the cleaning articles releasably containing the cleaning composition. The composition is released to the fabrics by contact with the carrier. It is preferred that heat be employed during the process. Of course, heat can easily be provided in a clothes dryer. The tumbling and optional (but preferred) heating is carried out for a period of at least about 10 minutes, typically from about 20 minutes to about 30 minutes. The process can be conducted for longer or shorter periods, depending on such factors as the degree and type of soiling of the fabrics, the nature of the soils, the nature of the fabrics, the fabric load, the amount of heat applied, and the like, according to the needs of the user.

The following illustrates a typical spherical article in more detail, but is not intended to be limiting thereof.

EXAMPLE I

Dry cleaning articles in spherical form are assembled using an open cell foam and a cleaning composition prepared by admixing the following ingredients.

| Ingredient | % (wt.) |
|---|---|
| BPP* | 7.0 |
| 1,2-octanediol | 0.5 |
| PEMULEN TR-1** | 0.15 |
| KOH | 0.08 |
| Perfume | 0.75 |
| Water and Minors*** | Balance |

*Isomer mixture, available from Dow Chemical Co.
**PEMULEN TR-2, B. F. Goodrich, may be substituted.
***Includes preservatives such as KATHON ®.

The cleaning composition can also optionally contain 0.50% (wt.) of a mixture of $MgAE_1S$, $MgAE_{6.5}S$ and $C_{12}$ amine oxide surfactants, in the range of 1:1:1 to 0.5:1:1. A 1:1 to 2:1 mixture of $MgAE_1S$/$C_{12}$ amine oxide can also be used.

Carrier spheres (1) as shown in FIG. 1 are prepared using a conventional open-cell polyurethane foam, or its equivalent. The spheres each have a diameter of about 3 cm.

About 7 grams of the above-noted cleaning composition are evenly applied to each of the spheres by dipping or spraying the composition onto the spheres, optionally followed by squeezing with a roller or pair of nip rollers, i.e., by "dip-squeezing" or "spray squeezing". The external surfaces of the spheres are wet but not tacky to the touch.

Dry cleaning spheres prepared in the foregoing manner are ready for use in the manner disclosed in Example II, packaging in kit form in the manner disclosed in Example III, hereinafter.

EXAMPLE II

The following illustrates a typical process herein in more detail, but is not intended to be limiting thereof.

Figure 2:
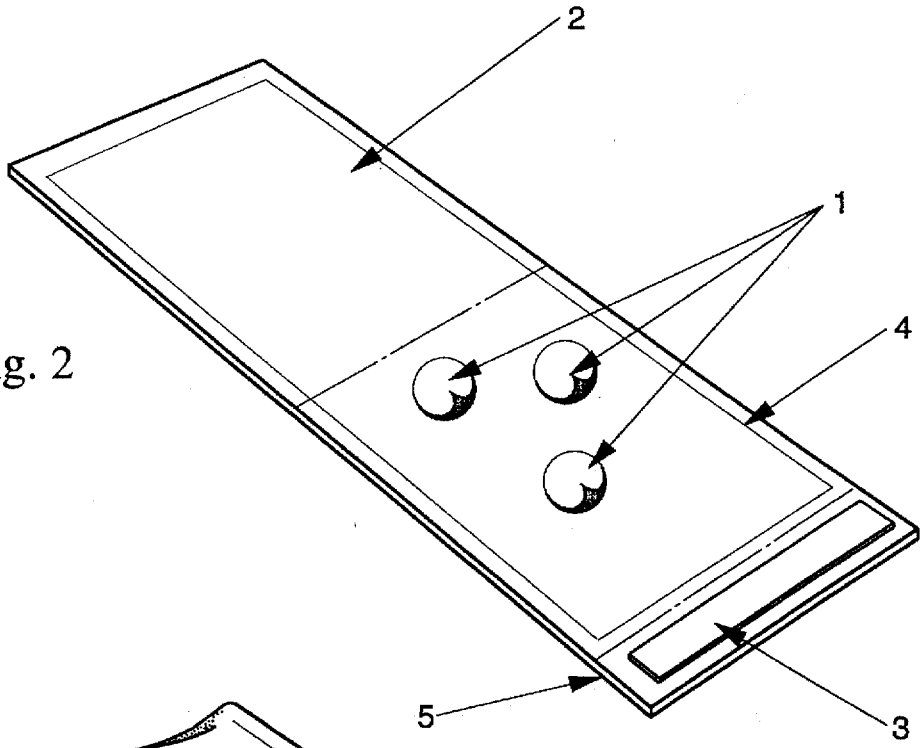
FIG. 2 is a perspective of three of the spheres resting on a plastic carrier bag in a pre-folded condition.
Figure 3:
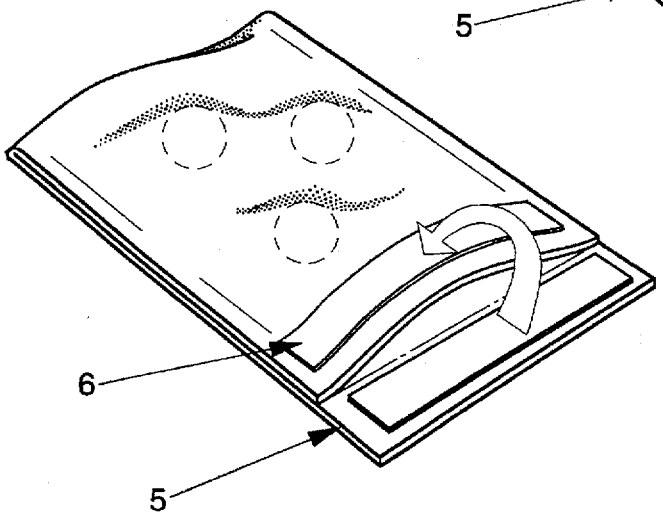
FIG. 3 is a perspective of three of the spheres within the bag which is ready to receive the fabrics to be dry cleaned.

As shown in FIG. 2, a flat sheet (2) of flexible plastic with a patch of Velcro®-type fastener is provided as a sealing means (3). A bag is formed by folding the sheet and bonding along border (4). As shown in FIG. 3, closure flap (5) with sealing means (3) allows closing and sealing of the bag by imposing sealing means (3) onto contact surface (6). In a typical mode, 3 to 10, preferably 5 to 10, dry cleaning spheres (1) of the type described in Example I are placed in the plastic bag having a volume of about 25,000 $cm^3$, as shown in FIG. 3. Up to about 2 kg of dry garments to be cleaned are then placed in the bag. When the garments and the dry cleaning spheres are placed in the bag, the air is preferably not squeezed out of the bag before closing and sealing. This allows the bag to billow, thereby providing sufficient space for the fabrics and cleaning spheres to tumble freely together. The bag is then closed, sealed and placed in a conventional hot-air clothes dryer. The dryer is started and the bag is tumbled for a period of 20–30 minutes at a dryer air temperature in the range from about 50° C. to about 85° C. During this time, the dry cleaning spheres move freely, thereby providing effective contact with the fabrics. After the machine cycle is complete, the bag and its contents are removed from the dryer, and the spent dry cleaning spheres are discarded. The plastic bag is retained for re-use.

The fabrics are cleaned and refreshed. The water present in the cleaning composition serves to minimize wrinkles in the fabrics.

In an alternate mode, heavily soiled areas of the fabric being cleaned can optionally be pre-treated by pressing or rubbing a fresh dry cleaning sphere according to this invention on the area. Several spheres and pre-treated fabric are then placed in the container, and the dry cleaning process is conducted in the manner described herein.

EXAMPLE III

The following illustrates a typical dry cleaning kit herein, but is not intended to be limiting thereof.

A dry cleaning kit is assembled packaging multiple (typically, 10–60) single use dry cleaning articles of the type described herein and depicted in the Figures, together with a sealable, reusable plastic container bag, in a package comprising a conventional cardboard box suitable for retail sales.

Having thus described and exemplified the present invention, the following further illustrates various cleaning compositions which can be formulated and used in the practice thereof.

EXAMPLE IV

| Ingredient | % (wt.) Formula Range |
|---|---|
| BPP* | 5–25% |
| 1,2-Octanediol | 0.1–7% |
| $MgAE_1S$ | 0.01–0.8% |
| $MgAE_{6.5}S$ | 0.01–0.8% |
| $C_{12}$ Dimethyl Amine Oxide | 0.01–0.8% |
| PEMULEN** | 0.05–0.20% |
| Perfume | 0.01–1.5% |
| Water | Balance |
| pH range from about 6 to about 8. | |

*Other solvents or co-solvents which can be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and PPP, and the like, and mixtures thereof. Indeed, although somewhat less preferred, the MPP, EPP and PPP, respectively, can replace the BPP solvent in the foregoing cleaning compositions. The levels of these solvents, and their ratios with 1,2-octanediol, are the same as with the preferred BPP solvent. If desired, and having due regard for safety and odor for in-home use, various conventionl chlorinated and hydrocarbon dry cleaning solvents may also be used. Included among these are 1,2-dichloroethane, trichloroethylene, isoparaffins, and mixtures thereof.

**As disclosed in U.S. Pats. 4,758,641 and 5,004,557, such polyacrylates include homopolymers which may be crosslinked to varying degrees, as well as non-crosslinked. Preferred herein are homopolymers having a molecular weight in the range of from about 100,000 to about 10,000,000, preferably 200,000 to 5,000,000.

Excellent cleaning performance is secured using any of the foregoing non-immersion processes and articles to provide from about 5 g to about 50 g of the cleaning compositions per kilogram of fabric being cleaned.

EXAMPLE V

A dry cleaning composition with reduced tendency to cause dye "bleeding" or removal from fabrics as disclosed above is as follows.

| INGREDIENT | PERCENT (wt.) | (RANGE) |
|---|---|---|
| Butoxypropoxy propanol (BPP) | 7.000 | 4.0–25.0% |
| NEODOL 23 - 6.5* | 0.750 | 0.05–2.5% |
| 1,2-Octanediol | 0.500 | 0.1–10.0% |
| Perfume | 0.750 | 0.1–2.0% |
| Pemulen TR-1 | 0.125 | 0.05–0.2% |
| Potassium Hydroxide (KOH) | 0.060 | 0.024–0.10 |
| Potassium Chloride | 0.075 | 0.02–0.20 |
| Water (distilled or deionized) | 90.740 | 60.0–95.0% |
| Target pH = 7.0 | | |

*Shell; $C_{12}$–$C_{13}$ alcohol, ethoxylated with average EO of 6.5.

15–25 Grams of a composition of the foregoing type are placed on 5–10 carrier spheres for use in the manner disclosed herein. A preferred carrier substrate used to produce the spheres comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244. The manufacture of such materials forms no part of this invention and is already disclosed in the literature. See, for example, U.S. Pat. Nos. 5,009,747, Viazmensky, et al., Apr. 23, 1991 and 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | $gm/m^2$ | 55 | 35–75 |
| Thickness | microns | 355 | 100–1500 |
| Density | gm/cc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | $gm/cm^2$ | 1050 | 700–1200 |

*MD - machine direction; CD - cross direction

As disclosed in U.S. Pat. Nos. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning compositions herein, but actually optimizes cleaning performance. While not intending to be limited by theory, it may be speculated that this carrier is more effective in delivering the cleaning composition to soiled fabrics. Or, this particular carrier might be better for removing soils by contact with the soiled fabrics, due to its mixture of fibers. Whatever the reason, improved dry cleaning performance is secured.

5–10 Spheres of the foregoing type are placed together with the fabrics to be dry cleaned in a flexible containment bag having dimensions as noted hereinabove and sealing means. In a preferred mode, the containment bag is constructed of thermal resistant film in order to provide resistance to hot spots (350° F.–400° F.; 177° C. to 204° C.) which can develop in some dryers. This avoids internal self-sealing and external surface deformation of the bag, thereby allowing the bag to be re-used.

In a preferred embodiment, 0.0025 mm to 0.0075 mm thickness nylon film is converted into a 26 inch (66 cm)×30 in. (76 cm) bag. Bag manufacture can be accomplished in a conventional manner using standard impulse heating equipment, air blowing techniques, and the like. In an alternate mode, a sheet of nylon is simply folded in half and sealed along two of its edges.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.). Nylon VELCRO®-type, ZIP-LOK®-type and/or zipper-type closures can be used to seal the bag, in-use.

Besides the optional nonionic surfactants used in the cleaning compositions and articles herein, which are preferably $C_8$–$C_{18}$ ethoxylated (E01–15) alcohols or the corresponding ethoxylated alkyl phenols, the compositions can contain enzymes to further enhance cleaning performance. Lipases, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

If an antistatic benefit is desired, the compositions used herein can contain an anti-static agent. If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The compositions herein can optionally be stabilized for storage using conventional preservatives such as KATHON® at a level of 0.001%–1%, by weight.

If the compositions herein are used in a spot-cleaning mode, they are preferably pressed (not rubbed) onto the fabric at the spotted area using an applicator pad comprising looped fibers, such as is available as APLIX 200 or 960 Uncut Loop, from Aplix, Inc., Charlotte, N.C. An underlying absorbent sheet or pad of looped fibers can optionally be placed beneath the fabric in this mode of operation.

What is claimed is:

1. A fabric cleaning article comprising a substantially spherical, or polyhedral, compressible absorbent substrate carrying a cleaning composition comprising an organic solvent, a polyacrylate emulsifier, water, 1-2 octanediol and optional surfactants removable to fabrics by contact therewith.

2. An article according to claim 1 wherein said substrate is spherical and has a diameter in the range from about 1 cm to about 5 cm.

3. An article according to claim 1 wherein said substrate is polyhedral and has an aspect ratio less than about 20:1.

4. An article according to claim 1 wherein the organic solvent is a member selected from the group consisting of methoxy-, ethoxy-, propoxy-, and butoxy-propoxypropanol, and mixtures thereof.

5. A method for cleaning fabrics in a tumbling apparatus, comprising placing said fabrics in a container together with one or more cleaning articles according to claim 1, closing said container, and tumbling said fabrics together with said cleaning articles.

6. A method according to claim 4 which is conducted in a hot air clothes dryer.

7. A dry cleaning composition in kit form, comprising the following components:

(a) multiple articles according to claim 1;

(b) a reusable container suitable for use in a hot air clothes dryer; and (c) an outer package containing said components (a) and (b).

* * * * *